United States Patent [19]

Cesari

[11] Patent Number: 5,022,574

[45] Date of Patent: Jun. 11, 1991

[54] UTILITY BAG

[76] Inventor: Jeffrey Cesari, 9996 Woodfern St., Philadelphia, Pa. 19115

[21] Appl. No.: 505,357

[22] Filed: Apr. 4, 1990

[51] Int. Cl.[5] ..... A45C 5/14; A45C 13/00; A45C 13/26

[52] U.S. Cl. ..... 224/153; 224/210; 190/18 A; 190/127

[58] Field of Search ..... 190/18 A, 18 R, 127, 190/107; 383/2, 4; 280/DIG. 3; 224/153, 209, 210

[56] References Cited

U.S. PATENT DOCUMENTS

| | | | |
|---|---|---|---|
| 1,099,933 | 6/1914 | Pohrer | 190/18 A X |
| 1,907,676 | 5/1933 | Roth | 190/109 X |
| 2,716,558 | 8/1935 | Sullivan | 280/DIG. 3 X |
| 3,197,225 | 7/1965 | Powell | 280/DIG. 3 X |
| 3,526,921 | 9/1970 | Aupke | 190/18 A X |
| 3,622,056 | 11/1971 | Droeger | 224/209 X |
| 3,653,474 | 4/1972 | Sadow | 190/18 A |
| 4,361,215 | 11/1982 | Sawai | 190/18 A |
| 4,420,103 | 12/1983 | Douglass | 224/210 |
| 4,593,841 | 6/1986 | Lange | 224/153 |
| 4,733,759 | 3/1988 | Shih-Chen | 190/18 A |
| 4,756,394 | 7/1988 | Cohen | 190/18 A |
| 4,838,396 | 6/1989 | Krenzel | 190/18 A |
| 4,951,818 | 8/1990 | Johnson | 190/107 X |

FOREIGN PATENT DOCUMENTS

| | | | |
|---|---|---|---|
| 588533 | 11/1933 | Fed. Rep. of Germany | 224/153 |
| 2651783 | 5/1978 | Fed. Rep. of Germany | 224/153 |
| 1563534 | 4/1969 | France | 190/18 A |
| 88344 | 9/1956 | Norway | 280/DIG. 3 |
| 867561 | 5/1961 | United Kingdom | 383/2 |
| 2031718 | 4/1980 | United Kingdom | 190/18 A |

*Primary Examiner*—Sue A. Weaver

*Attorney, Agent, or Firm*—Robert Charles Beam

[57] ABSTRACT

The present invention shows a multi-purpose, utility bag comprising:

a bag member, said bag member having a base portion and a back portion and being constructed of flexible material;

a support member integrated into said bag member and providing firm support for said bag member at least in the area of said base portion and said back portion of said bag member; and, a non-linear array of load-bearing, rotatable castors fixedly attached to the base portion of said support member permitting the utility bag to sit upright and roll across a flat surface upon said castors.

10 Claims, 1 Drawing Sheet

Fig. 1a
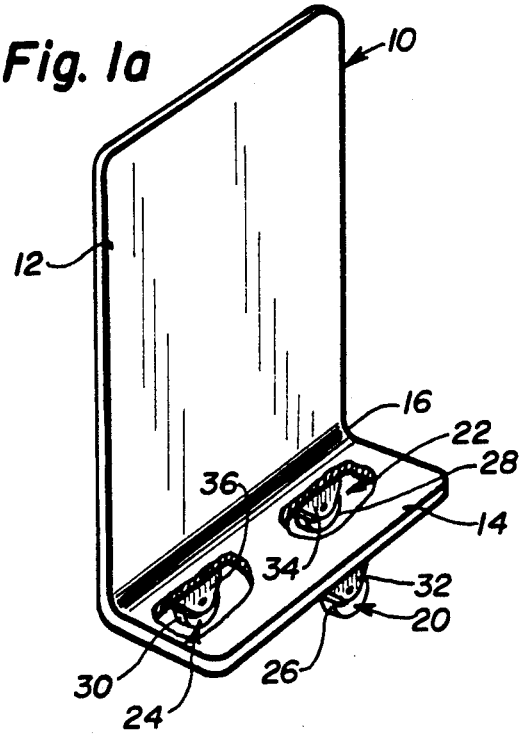
Fig. 1b
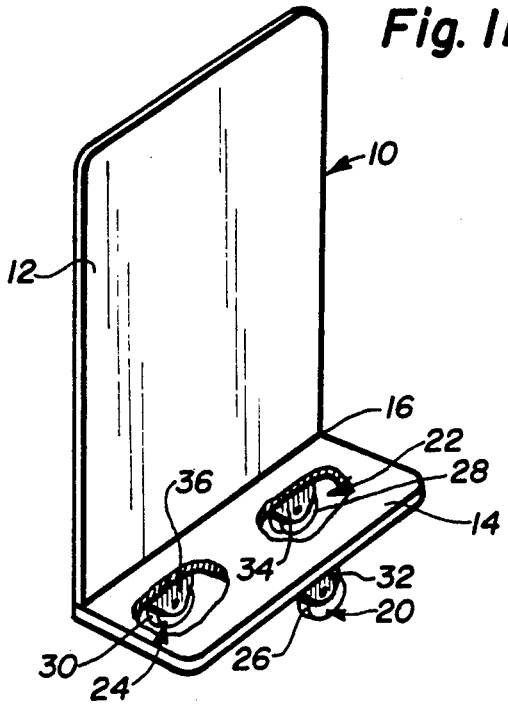
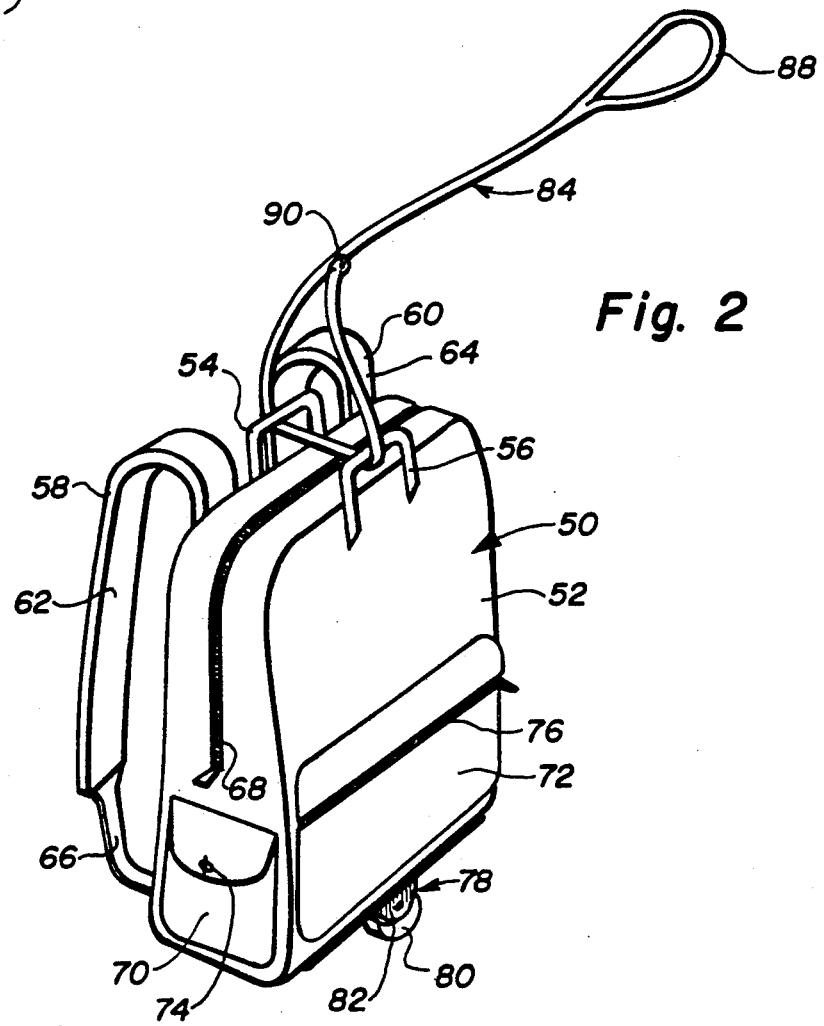
Fig. 2

UTILITY BAG

BACKGROUND OF THE INVENTION

1. Field of the Invention

The present invention relates to a multi-purpose utility bag. In particular, the present invention relates to a multi-purpose utility bag comprising:

a bag member, said bag member having a base portion and a back portion and being constructed of flexible material;

a support member integrated into said bag member and providing firm support for said bag member at least in the area of said base portion and said back portion of said bag member; and a non-linear array of load-bearing, rotatable castors fixedly attached to the base portion of said support member permitting the utility bag to sit upright and roll across a flat surface upon said castors.

2. Description of Related Art

Utility bags of various types are known to the prior art. One type of bag known for many years has been the "knapsack", typically a leather or canvas case for clothes and other supplies, carried on the back by soldiers, hikers and the like. Such bags have always been popular with students, as an inexpensive and convenient way of carrying books and other school supplies.

In recent years, however, it has become common to replace the more traditional leather or canvas material with a lightweight and inexpensive nylon or other synthetic material. Such constructions have proved suitable for most uses such bags encounter, and are often heavily loaded with books, baseball gloves, footballs, frisbees, and other objects necessary and unnecessary to the student.

Unfortunately, while such bags are designed to be worn on the back of the user, supported by shoulder straps, they are just as often carried by hand, using the same shoulder strap. Often, with such a bag in its typically overloaded condition, this results in the bag being dragged along the ground, pulled by the strap.

This abuse quickly results in damage to the bag, the bottom of which is fabricated from a material chosen for lightweight construction, and not adapted to the abrasive treatment which results from contact with concrete and asphalt surfaces.

Wheels have been fitted to other types of luggage. For example, it is common to see a traveller in an airport pulling a small cart with one or more suitcases strapped to it, or pulling along a suitcase provided with two small wheels by an attached handle. Larger suitcases and trunks may be provided with castors at each corner to assist in transporting them.

All of these devices are intended for occasional use with large, hard-bodied luggage. None are adapted to the everyday, intermittent, multi-terrain use of a student carrying, or dragging, a book bag.

SUMMARY OF THE INVENTION

It is an object of the present invention to provide a simple adaptation of the multi-purpose utility bag which will avoid the damage caused by pulling the bag across abrasive surfaces.

It is a further object of the present invention to provide a multi-purpose utility bag adapted to everyday, intermittent, multiterrain use.

According to the preferred embodiment of the present invention, there is provided a multi-purpose utility bag comprising a bag member, said bag member having a base portion and a back portion and being constructed of flexible material;

a support member integrated into said bag member and providing firm support for said bag member at least in the area of said base portion and said back portion of said bag member; and, a non-linear array of load-bearing, rotatable castors fixedly attached to the base portion of said support member permitting the utility bag to sit upright and roll across a flat surface upon said castors.

BRIEF DESCRIPTION OF THE DRAWINGS

FIG. 1*a* shows the support member of the present invention, partially broken away to show the attached castors.

FIG. 1*b* shows an alternative support member of the present invention, partially broken away to show the attached castors.

FIG. 2 shows a multi-purpose utility bag of the present invention.

DETAILED DESCRIPTION OF THE PREFERRED EMBODIMENT

FIG. 1*a* shows the support member of the present invention. The support member 10 is comprised of a back portion 12 and a base portion 14. The back portion 12 and base portion 14 may be formed from one integral piece of material bent at their juncture 16, and one-eighth inch or one-quarter inch Lexan has been used with success. Of course, the support member could be comprised of a separate back portion 12 and base portion 14 joined in some manner at the juncture 16 as shown in FIG. 1*b*, or by other similar construction.

The base portion 14 is further provided with a non-linear array of load-bearing castors 20, 22 and 24 fixedly attached to the base portion 14 of said support member 10. These castors 20, 22 and 24 are comprised of castor wheels 26, 28 and 30 mounted to the base member 14 by attachment means 32, 34 and 36. Commercially available one and five-eighths inch castor wheels have been used advantageously for this purpose. These castor wheels are suitably light in weight (the bag is still intended primarily to be carried) and rated to carry a loading weight of sixty pounds.

In FIG. 2 the multi-purpose utility bag 50 of the present invention is shown. The utility bag 50 consists of a bag portion 52, typically provided with handles 54 and 56 and shoulder straps 58 and 60. These shoulder straps 58 and 60 are typically provided with a padded portion 62 and 64 to provide greater comfort when the bag is carried on the shoulders. The straps are also provided with an unpadded lower portion 66 which connects with the lower portion of the bag typically is some kind of arrangement wherein the length of the strap can be adjusted for the comfort of the wearer, as is well known to the art.

The multi-purpose bag 50 is further provided with a closure mechanism for the body of the bag, illustrated in the present embodiment as zipper 68. The bag 50 may also be provided with any number of additional pockets, and side pocket 70 and front pocket 72 are illustrative. These pockets may be intended to be left open or may be secured by any of several means known to the art. Snap closure 74 is provided for fastening the side pocket 70, and zipper closure 76 is provided for fastening the front pocket 72.

The multi-purpose bag 50 of the present invention has been provided with the support member shown in FIG. 1*a*. This support member is inserted into a typical multi-purpose bag of this kind, and holes are cut in the bag bottom to accommodate the addition of the castors. The support member may be comprised of a material such as plexiglass or lexan. Castor 78 is visible at the bottom of the illustrated multi-purpose bag 50. This castor is comprised of wheel 80 and attachment means 82. Two additional castors (not shown) are similarly attached to the base portion of the internal support member through the material of the bag 50.

To facilitate movement of the bag 50, it may be useful to provide a detachable pull strap, such as that illustrated as 84 in FIG. 2. This pull strap may advantageously be fashioned of nylon or cotton webbing and stowed away when not in use in on of the convenient outer pockets, such as side pocket 70. The pull strap 84 may be conveniently provided with a handle 88 at the user's end, and a means for attaching the pull strap 84 at the opposite end. In the illustrated embodiment, a snap closure 90 is illustrated as a means to attach the pull strap 84, although many other means are known to the art.

Other features, advantages, and specific embodiments of this invention will become readily apparent to those exercising ordinary skill in the art after reading the foregoing disclosures. These specific embodiments are within the scope of the claimed subject matter unless otherwise expressly indicated to the contrary.

Moreover, while specific embodiments of this invention have been described in considerable detail, variations and modifications of these embodiments can be effected without departing from the spirit and scope of this invention as disclosed and claimed.

What is claimed is:

1. A multi-purpose utility bag comprising:

a bag member, said bag member having a base portion, front, back, and side portions and a top portion, all being constructed of flexible material, said bag member having a closure mechanism proximate to said top portion, and further being provided with handles proximate to the top portion of said bag member, and adjustable shoulder straps proximate to the back portion of said bag member, said shoulder straps being provided with padding for at least a portion of their length to provide greater comfort when the bag is carried on the shoulders of a user;

a support member itself having a base portion and a back portion formed from one integral piece of material bent into an "L"-shape, and integrated into said bag member such that the base portion of said support member is substantially co-extensive and co-terminus with the base portion of said bag member and the back portion of said support member is substantially co-extensive and co-terminus with the back portion of said bag member, said support member providing firm support for said bag member at least in the area of said base portion and said back portion of said bag member; and, a non-linear array of load-bearing, rotatable castors fixedly attached to the base portion of said support member and extending through the flexible material of the base portion of said bag member, permitting the utility bag to sit upright and roll across a flat surface upon said castors.

2. The utility bag of claim 1 further comprising a detachable pull strap adapted to pull the utility bag along a surface supported and rolling on the castors.

3. The utility bag of claim 2 further comprising at least one exterior pocket suitable for storing said detachable pull strap when not in use.

4. The utility bag of claim 4 wherein the support member is plexiglass.

5. The utility bag of claim 4 wherein the support member is lexan.

6. A multi-purpose utility bag comprising:

a bag member, said bag member having a base portion, a front, back, and side portions and a top portion, all being constructed of flexible material, said bag member having a closure mechanism proximate to said top portion, and further being provided with handles proximate to the portion of said bag member, and adjustable shoulder straps proximate to the back portion of said bag member, said shoulder straps being provided with padding for at least a portion of their length to provide greater comfort when the bag is carried on the shoulders of a user;

a support member itself having a base portion and a back portion formed from two separate pieces of material joined at their juncture into an "L"-shape, and integrated into said bag member such that the base portion of said support member is substantially co-extensive and co-terminus with the base portion of said bag member and the back portion of said support member is substantially co-extensive and co-terminus with the back portion of said bag member, said support member providing firm support for said bag member at least in the area of said base portion and said back portion of said bag member; and, a non-linear array of load-bearing, rotatable castors fixedly attached to the base portion of said support member and extending through the flexible material of the base portion of said bag member, permitting the utility bag to sit upright and roll across a flat surface upon said castors.

7. The utility bag of claim 6 further comprising a detachable pull strap adapted to pull the utility bag along a surface supported and rolling on the castors.

8. The utility bag of claim 7 further comprising at least one exterior pocket suitable for storing said detachable pull strap when not in use.

9. The utility bag of claim 6 wherein the support member is plexiglass.

10. The utility bag of claim 6 wherein the support member is lexan.

* * * * *